US005873217A

United States Patent [19]

Smith

[11] Patent Number: 5,873,217

[45] Date of Patent: Feb. 23, 1999

[54] VACUUM SEALING METHODS AND APPARATUS

[76] Inventor: George E. Smith, 93724 Prairie Rd., Junction City, Oreg. 97448

[21] Appl. No.: 853,758

[22] Filed: May 9, 1997

[51] Int. Cl.[6] ..... B65B 31/00

[52] U.S. Cl. ..... 53/434; 53/512; 53/133.4; 53/139.2; 53/405

[58] Field of Search ..... 53/512, 412, 133.4, 53/139.2, 481, 405, 469, 408, 434; 141/8, 65; 138/44; 426/410; 446/220

[56] References Cited

U.S. PATENT DOCUMENTS

| | | | |
|---|---|---|---|
| 3,501,888 | 3/1970 | Egli et al. | 53/512 |
| 3,968,620 | 7/1976 | Keltner | 53/434 |
| 4,103,471 | 8/1978 | Lowdermilk | 53/434 |
| 4,337,804 | 7/1982 | Maruscak | 53/434 |
| 4,514,962 | 5/1985 | Ausnit | 53/457 |
| 4,581,764 | 4/1986 | Plock et al. | 53/512 |
| 4,597,244 | 7/1986 | Pharo | 53/512 |
| 4,736,572 | 4/1988 | Fang et al. | 53/512 |
| 4,798,041 | 1/1989 | Bentsen | 53/468 |
| 4,928,829 | 5/1990 | Di Bernardo . | |
| 4,941,310 | 7/1990 | Kristen | 53/512 |
| 5,215,445 | 6/1993 | Chen | 53/512 |
| 5,228,271 | 7/1993 | Wallace | 53/512 |
| 5,450,963 | 9/1995 | Carson . | |
| 5,480,030 | 1/1996 | Sweeney et al. . | |
| 5,537,806 | 7/1996 | Grierson et al. . | |

FOREIGN PATENT DOCUMENTS

| | | |
|---|---|---|
| 0 139 889 | 5/1985 | European Pat. Off. . |
| 31 23 988 | 3/1982 | Germany . |
| 871349 | 6/1961 | United Kingdom . |

*Primary Examiner*—Daniel B. Moon
*Assistant Examiner*—John Paradiso
*Attorney, Agent, or Firm*—David S. Alavi

[57] ABSTRACT

Described and/or claimed herein is a method for vacuum sealing articles in a substantially air-tight container comprising the steps of: 1) placing the article in the container; 2) turning on a vacuum source having an elongated nozzle end; 3) inserting the nozzle into the container; 4) sealing the container as completely as possible around the nozzle; 5) waiting for air to be withdrawn from the container through the nozzle; 6) removing the nozzle from the container; and 7) completely sealing the container with the article therein. Described and/or claimed herein is a nozzle adaptor for vacuum sealing an article in a substantially air-tight container using a household vacuum cleaner, comprising a vacuum hose engaging end and an elongated nozzle end terminating in a small nozzle orifice, said hose engaging end substantially sealedly engaging a free end of a vacuum hose, whereby said nozzle adaptor is substantially secured onto said vacuum hose when said vacuum cleaner is turned on and air is drawn through said nozzle orifice and into said vacuum hose. Described and/or claimed herein is a hand-held vacuum source for vacuum sealing an article in a substantially air-tight container having an elongated nozzle end for insertion into the container.

7 Claims, 5 Drawing Sheets

VACUUM SEALING METHODS AND APPARATUS

FIELD OF THE INVENTION

The field of the present invention relates to vacuum sealing methods and apparatus. In particular, vacuum sealing methods and apparatus are described herein enabling vacuum sealing without specialized containers.

BACKGROUND

Vacuum sealing is a well known technique for increasing the shelf life of a wide variety of articles. Numerous types of apparatus and methods for vacuum sealing articles in plastic bags have been previously introduced. Some of these are described in U.S. Pat. Nos. 4,928,829, 5,450,963, 5,480,030, and 5,537,806. Other devices for vacuum sealing include Pump N Seal, Pro Seal, Seal A Meal, Deni Vacuum Food Sealer, FoodSaver, FreshSaver, and VacLoc bags. Many of these apparatus are expensive and complex, requiring the purchase of specialized equipment and bags. Previous vacuum sealing systems may include a vacuum source, a bag welder or other bag sealing device, and/or a one-way valve through which the bag may be evacuated. The bags used with such apparatus are expensive and must typically be purchased from the manufacturer of the vacuum sealer. The bags may be adapted to include a one-way valve or means for sealing the bag after it has been evacuated. Some of these previous vacuum sealing systems employ a household vacuum cleaner as the vacuum source. However, these systems still require complex valves and/or bag sealing equipment. A need therefore exists for economical methods and apparatus for enabling vacuum sealing without specialized containers. Such methods and apparatus may employ a household vacuum cleaner as the vacuum source and zipper-type plastic bags (such as Zip-Lock® bags) available at grocery stores or other retail outlets.

SUMMARY OF THE INVENTION

Certain aspects of the present invention may overcome aforementioned drawbacks of the previous art and advance the state-of-the-art of vacuum sealing methods and apparatus, and in addition may meet one or more of the following objects:

- To provide methods and apparatus for vacuum sealing an article in a substantially air-tight storage container;
- To provide methods and apparatus for vacuum sealing an article in a substantially air-tight storage container which does not require specialized containers;
- To provide methods and apparatus for vacuum sealing an article in a zipper-type plastic bag;
- To provide an adapter nozzle for using a household vacuum cleaner for evacuating a substantially air-tight storage container prior to sealing;
- To provide a method for using a household vacuum cleaner for evacuating a substantially air-tight storage container prior to sealing; and
- To provide a hand-held vacuum source with a nozzle end for evacuating a substantially air-tight storage container prior to sealing.

One or more of these objects may be achieved in the present invention by a method for vacuum sealing articles in a substantially air-tight container comprising the steps of: 1) placing the article in the container; 2) turning on a vacuum source having an elongated nozzle end; 3) inserting the nozzle into the container; 4) sealing the container as completely as possible around the nozzle; 5) waiting for air to be withdrawn from the container through the nozzle; 6) removing the nozzle from the container; and 7) completely sealing the container with the article therein.

One or more of the objects may be achieved in the present invention by a nozzle adaptor for vacuum sealing an article in a substantially air-tight container using a household vacuum cleaner, comprising a vacuum hose engaging end and an elongated nozzle end terminating in a small nozzle orifice, said hose engaging end substantially sealedly engaging a free end of a vacuum hose, whereby said nozzle adaptor is substantially secured onto said vacuum hose when said vacuum cleaner is turned on and air is drawn through said nozzle orifice and into said vacuum hose.

One or more of the objects may be achieved in the present invention by a hand-held vacuum source vacuum for sealing an article in a substantially air-tight container having an elongated nozzle end for insertion into a substantially air-tight container.

Additional objects and advantages of the present invention may become apparent upon referring to the preferred and alternative embodiments of the present invention as illustrated in the drawings and described in the following written description and/or claims.

DETAILED DESCRIPTION OF PREFERRED AND ALTERNATIVE EMBODIMENTS

For purposes of this specification, including the appended claims, the term vacuum source shall denote any means for generating a pressure differential, including but not limited to a pump, a vacuum cleaner, a fan, a turbine, aspirator, combinations thereof, and/or functional equivalents thereof.

Figure 1:
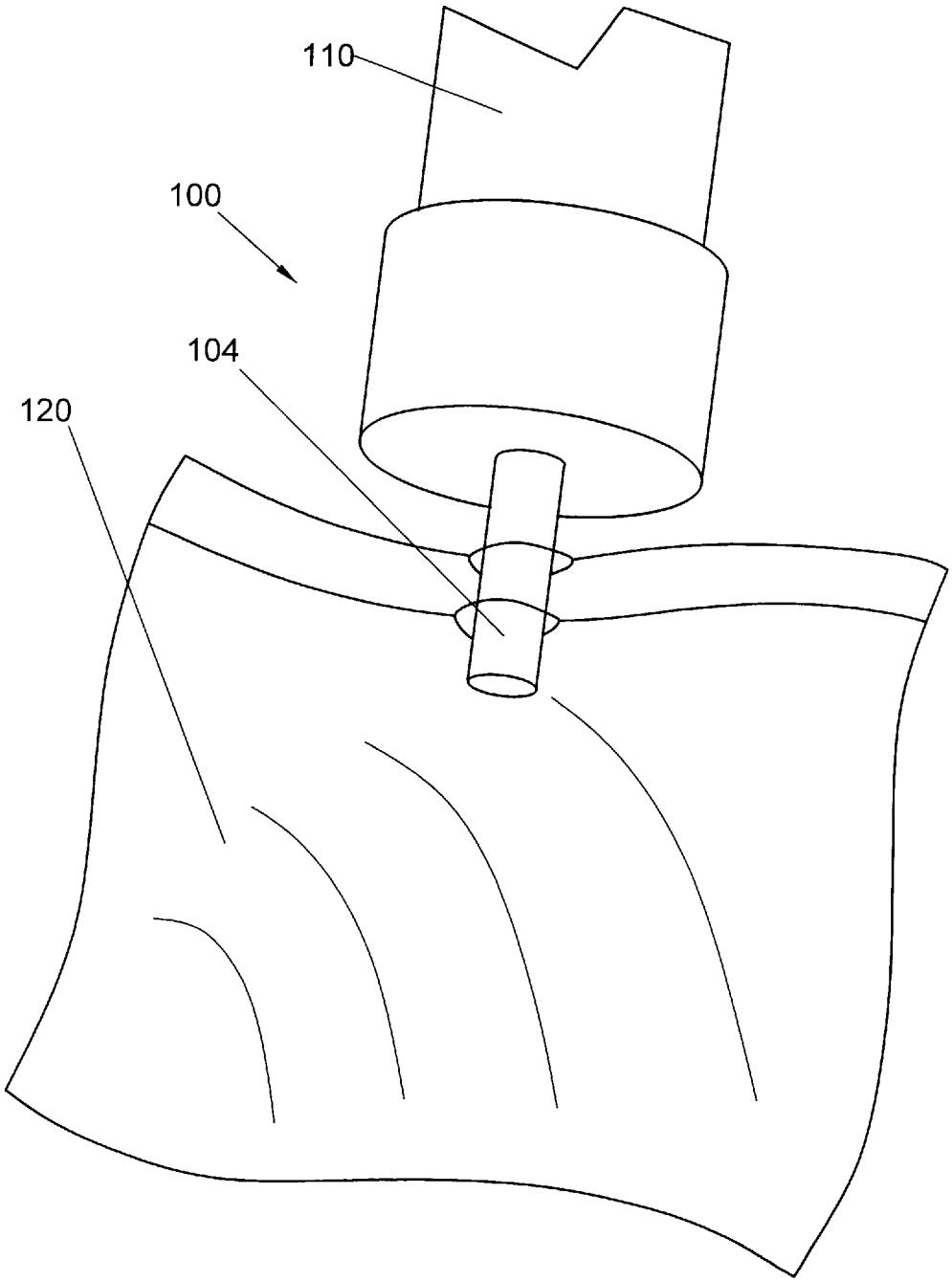
FIG. 1 illustrates a nozzle adaptor placed on a vacuum hose and inserted into a zipper-type plastic bag, according to the present invention.
Figure 2A:
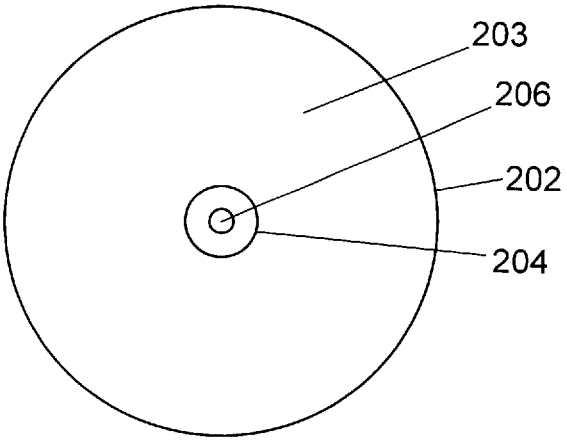
FIG. 2 shows three views and one cross section of a nozzle adaptor according to the present invention.
Figure 2B:
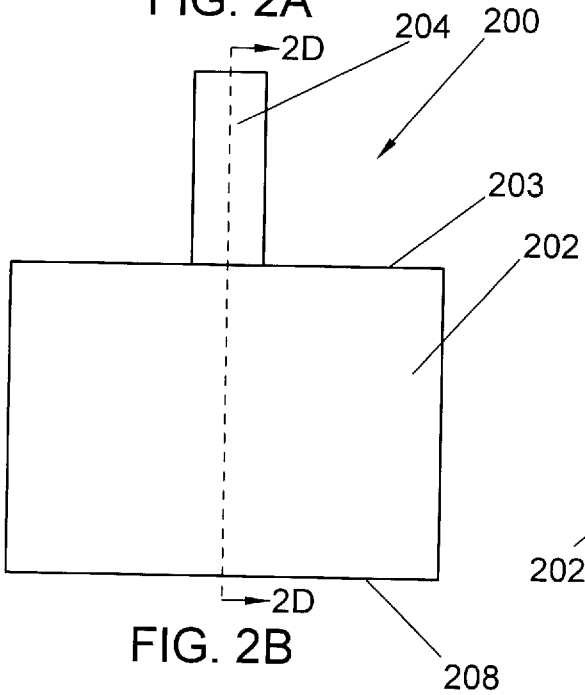
Figure 2D:
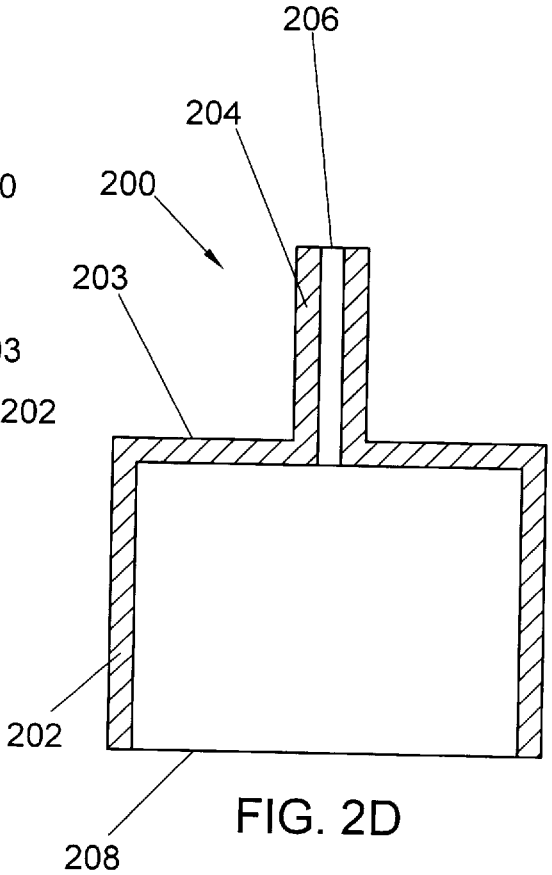
Figure 2C:
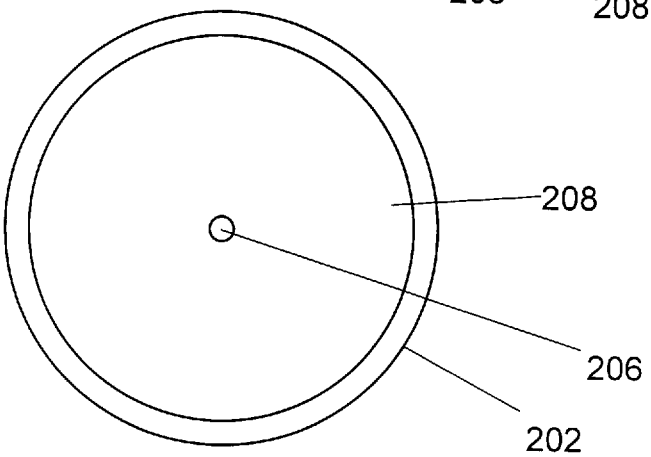
Figure 3A:
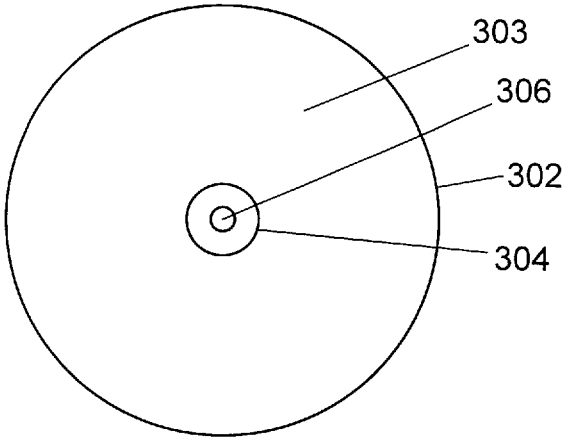
FIG. 3 shows three views and one cross section of a nozzle adaptor according to the present invention.
Figure 3B:
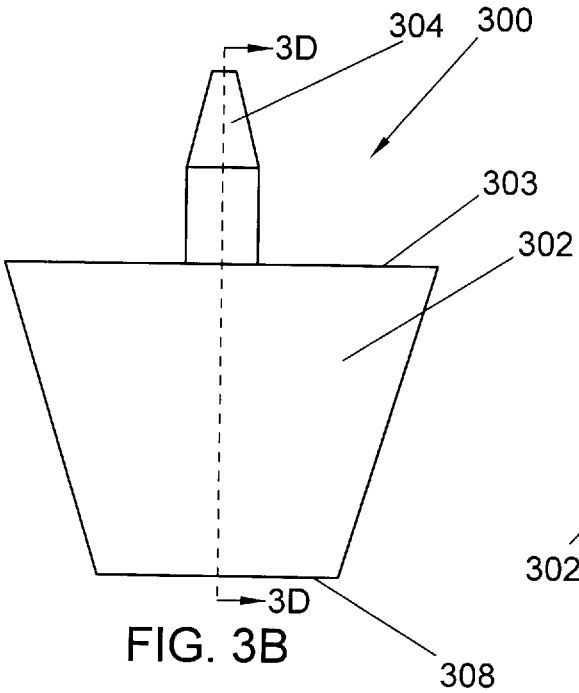
Figure 3D:
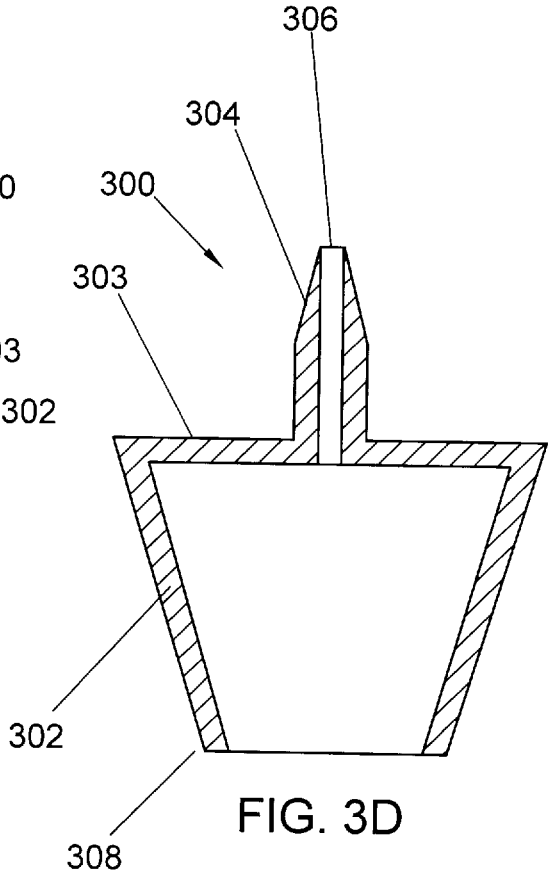
Figure 3C:
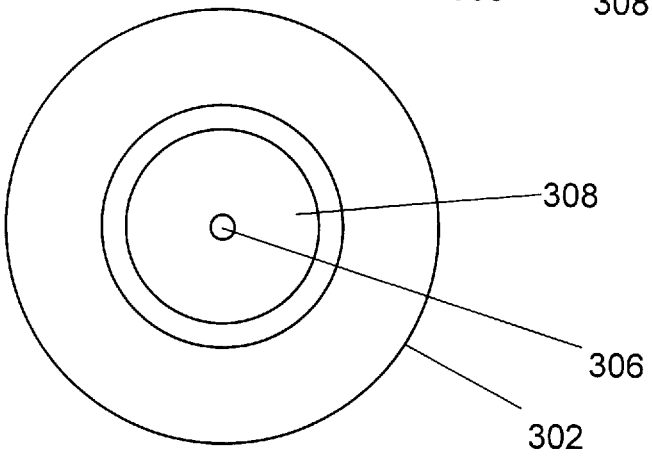
Figure 4A:
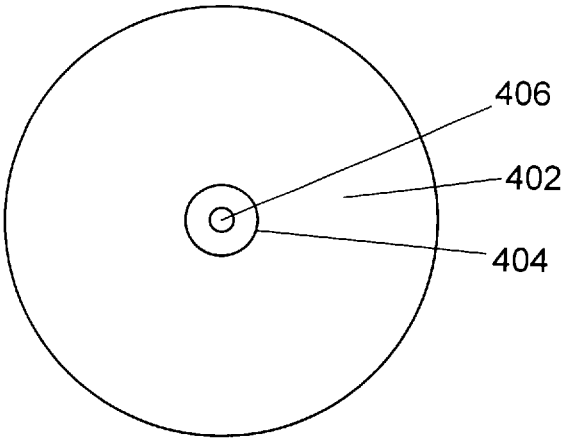
FIG. 4 shows three views and one cross section of a nozzle adaptor according to the present invention.
Figure 4B:
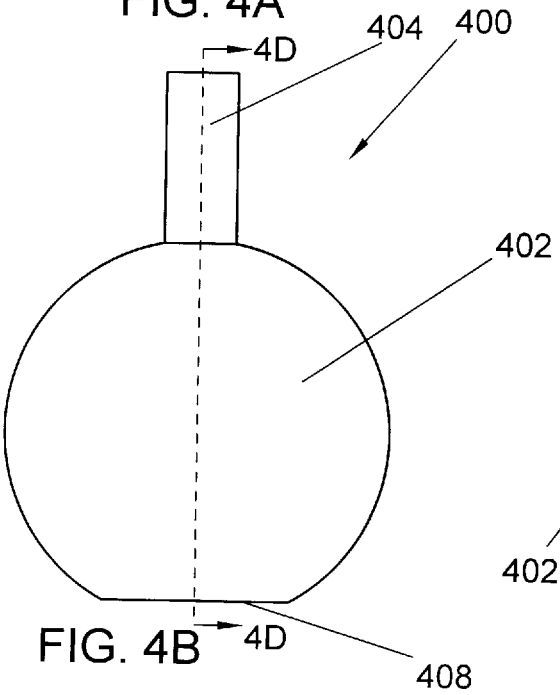
Figure 4D:
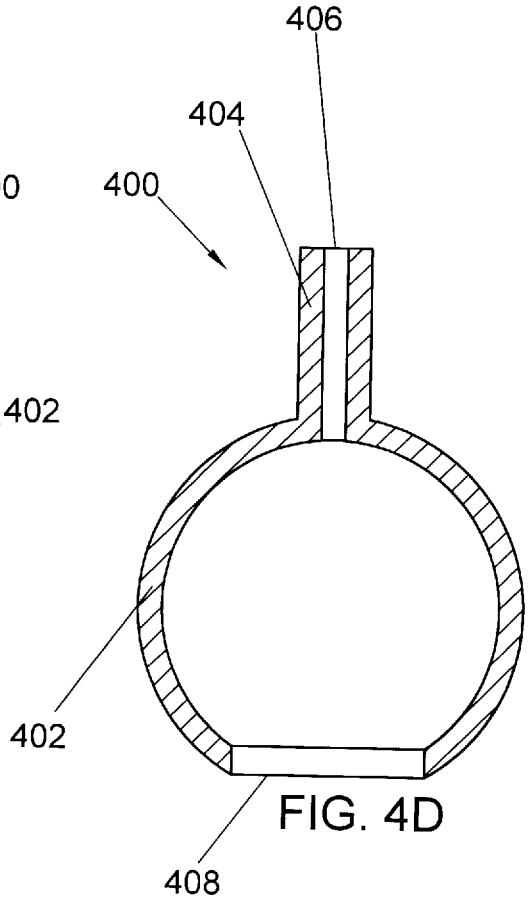
Figure 4C:
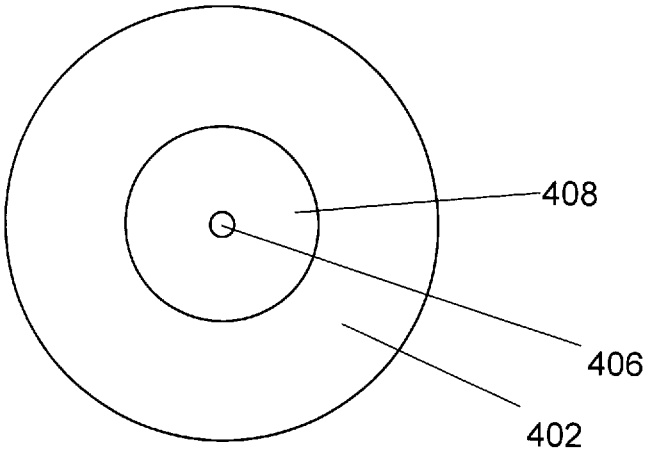

A preferred method for vacuum sealing an article in a substantially air-tight container comprises the steps of: 1) placing the article in the container; 2) turning on a vacuum source having an elongated nozzle end; 3) inserting the nozzle end into the container; 4) sealing the container as completely as possible around the nozzle end; 5) waiting for air to be withdrawn from the container through the nozzle adaptor and vacuum hose; 6) removing the nozzle end from the container; and 7) completely sealing the container with the article therein. The vacuum source may preferably comprise a vacuum cleaner having a vacuum hose and a nozzle adaptor substantially secured to the end of the hose. The vacuum cleaner may be any of a wide variety of vacuum cleaners available that include a hose and a connection for the hose. The nozzle adaptor serves to terminate the vacuum hose with a narrow elongated nozzle end which may be readily inserted into the container, preferably a zipper-type plastic bag available in grocery or other retail outlets. The bag is then zipper-sealed as completely as possible around the nozzle end, thereby causing air to be withdrawn from the bag when the vacuum cleaner is turned on. FIG. 1 shows a vacuum hose 110 and a nozzle adaptor 100, with nozzle end 104 inserted into zipper-type plastic bag 120, which is zipper-sealed around nozzle end 104 for withdrawal of air from bag 120 through nozzle adaptor 100 and vacuum hose 110. The nozzle end may be positioned at any point along the zipper-type opening of the bag. When the bag is sufficiently evacuated (a condition which may depend on the nature of the article being sealed), the nozzle end is quickly removed from the bag and the open portion of the zipper-type seal is quickly engaged before a substantial amount of air can return into the bag.

In a preferred embodiment of the present invention as illustrated in FIG. 2, hose engaging end 202 of nozzle adaptor 200 comprises a substantially cylindrical tube having an open end 208 for receiving the free end of the vacuum hose, a closed end 203 for substantially sealedly engaging the free end of the vacuum hose, and an inner diameter sufficiently large to receive the free end of the vacuum hose. A relatively large tube inner diameter allows a range of vacuum hose sizes to be accommodated. Nozzle end 204 comprises an elongated substantially cylindrical small diameter tube terminating in nozzle orifice 206. Nozzle end 204 is connected to closed end 203 of hose engaging end 202, which has an opening therethrough allowing air flow through the nozzle end 204 into the hose engaging end 202. Closed end 203 of hose engaging end 202 substantially sealedly engages the end of the vacuum hose inserted into open end 208. When the vacuum cleaner is turned on, sufficient suction is developed to substantially secure nozzle adaptor 200 onto the end of the vacuum hose. Imperfect sealed engagement of closed end 203 with the free end of the vacuum hose may serve to limit the air flow generated through the nozzle orifice. The nozzle adaptor may be preferably fabricated from injection-molded plastic, but may be lo fabricated from any of a wide range of materials possessing sufficient rigidity to perform as described herein, including but not limited to any of a variety of polymeric resins and/or plastics, natural and/or synthetic rubber, metal, combinations thereof, and/or functional equivalents thereof.

In an alternative embodiment of a nozzle adaptor 300 of the present invention, as shown in FIG. 3, nozzle end 304 may comprise an elongated, tapered tube terminating in nozzle orifice 306. Hose engaging end 302 may comprise a substantially frustoconical tube having a closed base portion 303 and an open apex portion 308. The outer diameter of the apex portion 308 is sufficiently small to allow its insertion into the free end of the vacuum hose, while the outer diameter of closed base portion 303 is sufficiently large to prevent insertion of the entire nozzle adaptor 300 into the vacuum hose. The outer surface of frusto-conical tube 302 substantially sealedly engages the free end of the vacuum hose, thereby substantially securing nozzle adaptor 300 in place while the vacuum cleaner is turned on. Imperfect sealed engagement of frusto-conical tube 302 with the free end of the vacuum hose may serve to limit the air flow generated through the nozzle orifice. A relatively large base diameter and relatively small apex diameter allow a range of vacuum hose sizes to be accommodated.

In an alternative embodiment of a nozzle adaptor 400 of the present invention, as shown in FIG. 4, hose engaging end 402 may comprise a substantially spherical shell having an opening 408. The diameter of opening 408 is sufficiently small to prevent insertion of the free end of the vacuum hose, while the outer diameter of the spherical shell is sufficiently large to prevent insertion of the entire nozzle adaptor 400 into the vacuum hose. The outer surface of spherical shell substantially sealedly engages the free end of the vacuum hose, thereby substantially securing nozzle adaptor 400 in place while the vacuum cleaner is turned on. Imperfect sealed engagement of spherical shell 402 with the free end of the vacuum hose may serve to limit the air flow generated through the nozzle orifice. A relatively large spherical shell outer diameter and relatively small opening allow a range of vacuum hose sizes to be accommodated. The substantially spherical shape of hose engaging end 402 allows tilting of nozzle adaptor 400 relative to the vacuum hose while maintaining substantially sealed engagement, thereby allowing insertion of nozzle end 404 into a container over a range of angles relative to the vacuum hose and enhancing the ease of use of the nozzle adaptor.

Without departing from inventive concepts disclosed and/or claimed herein, the nozzle end may comprise an elongated tube having any cross sectional shape suitable for substantially sealing the container therearound, including but not limited to circular, oval, elliptical, rectangular, square, and/or polygonal. One or both transverse dimensions of the nozzle end may be substantially smaller than the corresponding transverse dimension of the hose engaging end. The elongated tube may be substantially straight, curved, tapered over its entire length, and/or tapered over only part of its length. The elongated tube may assume any orientation with respect to the vacuum hose and/or hose engaging end. Without departing from inventive concepts disclosed and/or claimed herein, the hose engaging end of the nozzle adaptor may be any combination of inner and outer shapes that allows substantially sealed engagement with the free end of the vacuum hose. Without departing from inventive concepts disclosed and/or claimed herein, the methods and apparatus described herein may be employed for vacuum sealing an article in any substantially airtight container which may be sufficiently sealed around the nozzle end for evacuation of the container, including but not limited to: zipper-type plastic bags, twisted plastics bags, tied plastic bags, rigid plastic containers with lids (Tupperware®, for example), jars, bottles, cans, and/or functional equivalents thereof.

Figure 5:
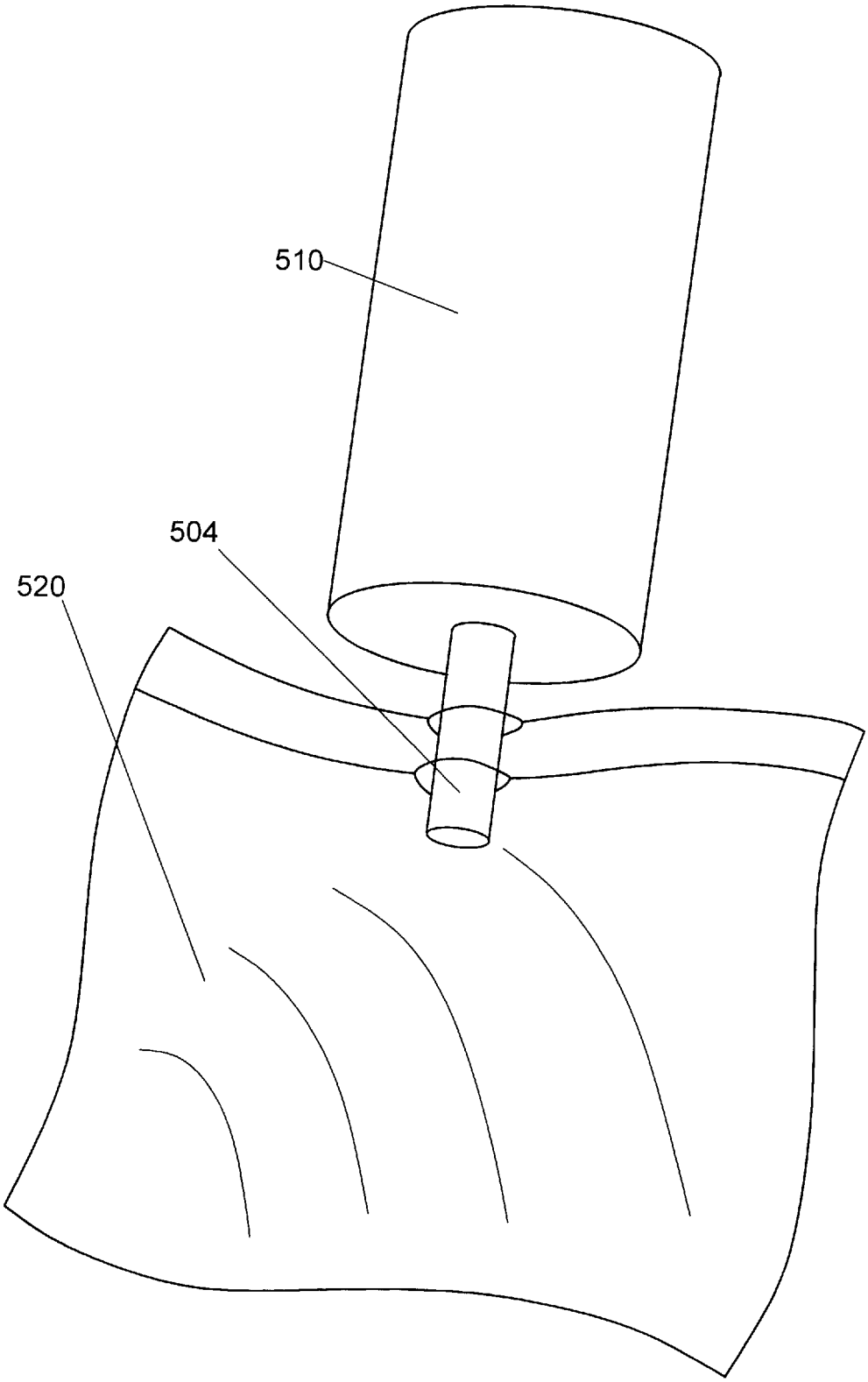
FIG. 5 illustrates a hand-held vacuum source with a nozzle end inserted into a zipper-type plastic bag, according to the present invention.

FIG. 5 illustrates a hand-held vacuum source 510 with a nozzle end 504, with nozzle end 504 inserted into zipper-type plastic bag 520, which is zipper-sealed around nozzle end 504 for withdrawal of air from bag 520 through nozzle end 504 and into vacuum source 510. Preferred and alternative methods of use and structures for the nozzle end are analogous to those set forth hereinabove.

The present invention has been set forth in the form of its preferred and alternative embodiments. It is nevertheless intended that modifications to the disclosed vacuum sealing methods and apparatus may be made without departing from inventive concepts disclosed and/or claimed herein.

I claim:

1. A method for vacuum sealing an article in a substantially air-tight zipper-type plastic bag, comprising the steps of:

a) placing said article into said zipper-type plastic bag;

b) turning on a vacuum source having an elongated nozzle end;

c) inserting said nozzle end into said zipper-type plastic bag;

d) substantially sealing said zipper-type plastic bag around said nozzle end;

e) waiting for a desired amount of air to be withdrawn from said zipper-type plastic bag through said nozzle end;

f) removing said nozzle end from said zipper-type plastic bag; and g) substantially sealing said zipper-type plastic bag with said article contained therein, wherein said vacuum source comprises a household vacuum cleaner, said vacuum cleaner having a vacuum hose connected thereto having a free end with a nozzle adaptor substantially secured thereto, said nozzle adaptor comprising a hose engaging end and said elongated nozzle end, and terminating in a small nozzle orifice, said hose engaging end substantially sealedly engaging said vacuum hose, whereby said nozzle adaptor is substantially secured to said vacuum hose when said vacuum cleaner is turned on and air is drawn through said nozzle orifice and into said vacuum hose.

2. A method for vacuum sealing as recited in claim 1, wherein said hose engaging end of said nozzle adaptor comprises a substantially cylindrical tube having an open end, a closed end, and an inner diameter sufficiently large to allow insertion of said free end of said vacuum hose thereinto, said closed end being connected to said nozzle end and having an opening therethrough allowing air flow through said nozzle end into said hose engaging end.

3. A method for vacuum sealing as recited in claim 1, wherein said hose engaging end comprises a substantially frusto-conical tube having a closed base, an open apex, an outer apex diameter sufficiently small to allow insertion of said apex into said free end of said vacuum hose, and an outer base diameter sufficiently large to prevent insertion of said base into said free end of said vacuum hose, said base being connected to said nozzle end and having an opening therethrough allowing air flow through said nozzle end into said hose engaging end.

4. A method for vacuum sealing as recited in claim 1, wherein said hose engaging end comprises a substantially spherical hollow shell having an outer diameter sufficiently large to prevent insertion of said spherical shell into said free end of said vacuum hose, having an opening sufficiently small to prevent insertion of said free end of said vacuum hose thereinto, being connected opposite said opening to said nozzle end, and having an opening therethrough opposite said opening allowing air flow through said nozzle end into said hose engaging end.

5. A method for vacuum sealing as recited in claim 1, wherein said elongated nozzle end comprises an elongated substantially cylindrical tube.

6. A method for vacuum sealing as recited in claim 1, wherein said elongated nozzle end comprises an elongated tapered tube.

7. A method for vacuum sealing as recited in claim 1, wherein said vacuum source comprises a hand-held vacuum source with an elongated nozzle end.

* * * * *